US005144712A

United States Patent [19]

Hansel et al.

[11] Patent Number: 5,144,712

[45] Date of Patent: Sep. 8, 1992

[54] DISPOSABLE TOOTHBRUSH

[76] Inventors: Gail W. Hansel; Phillip D. Fausett, both of 4621 Willow Run Dr., Annandale, Va. 22003

[21] Appl. No.: 695,892

[22] Filed: May 6, 1991

[51] Int. Cl.[5] ..... A46B 9/04; A46B 5/02; A46B 11/00

[52] U.S. Cl. ..... 15/167.1; 15/145; 15/176.6; 15/184; 15/144.4; 401/268

[58] Field of Search ..... 15/167.1, 172, 176.1, 15/176.6, 184, 188, 145, 144 B; 132/368, 310, 311; 401/269, 268

[56] References Cited

U.S. PATENT DOCUMENTS

| | | | |
|---|---|---|---|
| 1,121,082 | 12/1914 | Farrar | 15/184 |
| 1,188,823 | 6/1916 | Plank | 15/167.1 |
| 1,853,854 | 4/1932 | Frank | 15/176.6 |
| 2,039,278 | 5/1936 | Blanchard | 15/188 |
| 2,883,692 | 4/1959 | Kaye | 15/184 |
| 3,879,139 | 4/1975 | Dahl | 15/176.1 |
| 4,530,129 | 7/1985 | Labick | 15/184 |
| 4,693,622 | 9/1987 | Booth | 132/311 |

*Primary Examiner*—Harvey C. Hornsby
*Assistant Examiner*—Terrence R. Till

[57] ABSTRACT

A disposable toothbrush which includes a tubular housing forming a handle and a telescopically slidable brush head carrier mounted in the housing. The brush head carrier includes a brush head with tapered plastic bristles which have a central cup position therein to receive dentifrice. The brush head is pivoted to the carrier and forms a closure for the end of the tubular housing when in retracted position. A wedge-shaped member on the brush head retains it in optimum brushing position. A retaining projection on the brush head retains the brush head in optimum brushing position and a latch structure retains the carrier in extended relation to the tubular housing. The brush head includes a removable bristle assembly to enable multiple use cycles of the toothbrush.

13 Claims, 2 Drawing Sheets

DISPOSABLE TOOTHBRUSH

BACKGROUND OF THE INVENTION

1. Field of the Invention

The present invention generally relates to an oral hygienic device and more specifically a disposable toothbrush containing medicated or non-medicated dentifrice and either a single dose or multiple doses of dentifrice to enable a single use and disposal or disposal after multiple uses. The disposable toothbrush includes a tubular housing of generally oval-shaped configuration and a slidably extendable and retractable, longitudinally elongated bristle head carrier having a pivotal bristle head at one end which partially telescopes into the end of the tubular housing when the bristle head and bristle head carrier are in retracted position and pivots to an angulated relation to the bristle head carrier when in the extended position. The oval-shaped housing is approximately 3" in length with the carrier and brush head extending approximately 3" from the housing when in extended position to enable the housing to form a handle for the toothbrush. The oval-shaped transverse configuration of the housing includes a major diameter of just over 1" to enable the device to be easily carried in a pocket when in a retracted or collapsed position without producing a noticeable bulge or distortion of a garment. A latch structure retains the brush head carrier in extended position and the brush head telescopes into the end of the tubular housing when in retracted position. In the single use model of the toothbrush, the dentifrice is preloaded in the bristle head and in the multi-use model, there is a reservoir for a multi-load dentifrice cartridge in the tubular housing which forms the handle to enable the user to reload the bristle head with dentifrice for up to five use cycles. The bristle head includes a snap-on feature to enable the bristle heads to be replaced during each use cycle.

2.Description of the Prior Art

It is well known that pathogenic germs thrive on the bristles of a conventional toothbrush and it has been established that the toothbrush is responsible for the transmission of various infections. Various pathogenic organisms such as bacteria, fungi, yeasts and viruses can remain alive on a moist toothbrush for up to a week. The toothbrush is used in the mouth which is a known bacteria containing area and the usually moist bathroom in which the toothbrush is stored assists and in some instances accelerates microbial growth. Cleaning the conventional toothbrush by a simple "rinse and tap method" is generally ineffective in removing toothpaste residue, saliva, and food debris trapped in the bristles or tufts all of which provide an environment to maintain pathogenic organisms alive which can provide a potential for cross-contamination caused by the various pathogenic organisms remaining alive on the toothbrush.

It is also recognized that it is desirable to brush your teeth at more frequent time intervals, such as after eating. However, this is difficult to accomplish since individuals usually do not have toothbrushing equipment available throughout a work day, when travelling or the like. There have been efforts made to provide a collapsible or travelling toothbrush which are sometimes provided with a supply of dentifrice. However, such devices are relatively bulky and not disposable. Thus, while such devices facilitate brushing the teeth at more frequent time intervals, they still have the problem of pathogenic organisms remaining alive on the toothbrush bristles.

The following U.S. patents are relevant to this invention. U.S. Pat. Nos.

2,454,995, 2,620,500, 2,668,973, 2,828,504, 3,205,521, 4,344,535, 4,482,263, 4,530,129, 4,542,828, 4,695,177, 4,866,809,

The prior art in this field of endeavor does not include a disposable toothbrush of small compact size which can be extended to approximate a full size toothbrush with the bristle head being angled with the toothbrush being constructed in a manner to render the device economically disposable after a single use or after a limited number of uses.

SUMMARY OF THE INVENTION

An object of the present invention is to provide a disposable toothbrush constructed in a single use model and a multiple use model with the toothbrush being normally disposed in a compact, collapsed or retracted position of relatively small size to be easily carried in a pocket of a garment, a briefcase, suitcase, handbag and the like and easily extendable into its use position with the dentifrice being preloaded into the bristle head in a manner that it is only necessary to apply water to the bristle head for use of the toothbrush in a conventional manner.

Another object of the invention is to provide a disposable toothbrush which can be effectively distributed in the consumer market as well as the clinical market and can be offered for sale in various outlets including vending machines or as portions of a visitor kit by hotels and the like with the components being constructed of relatively inexpensive plastic components with the construction of the toothbrush eliminating the potential for cross-contamination caused by bacteria or viruses which can remain alive on a moist toothbrush for up to seven days.

A further object of the invention is to provide a disposable toothbrush constructed of two components including a tubular housing slidably receiving a bristle head carrier having a bristle head on one end thereof to enable the bristle head and carrier to move between a retracted or collapsed position where the overall length is approximately 3" and an extended position where the overall length is approximately 6" with the tubular housing forming a handle for the carrier and bristle head and a latch structure is provided to retain the carrier and bristle head releasably in extended position to retain the handle and carrier and bristle head in a rigid relationship to facilitate manipulation of the bristle head of the toothbrush in a conventional manner.

Still another object of the invention is to provide a disposable toothbrush in accordance with the preceding objects in which the bristle head includes a detachable mounting arrangement on the bristle head carrier to enable replacement of the portion of the bristle head having the bristles and dentifrice receiving cup therein with the bristle head mounting arrangement also including a pivotal connection with the elongated bristle head carrier which slides in the housing and a structure which maintains optimum angle of the bristle head in relation to the bristle head carrier and handle.

A still further object of the invention is to provide a disposable toothbrush constructed of relatively inexpensive materials and being relatively simple in construction to enable it to be manufactured and sold at a price that renders it economically feasible to be disposed of after a single use or a limited number of uses.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
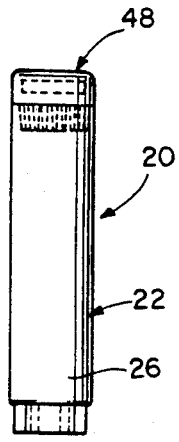
FIG. 1 is a vertical elevational view of the disposable toothbrush of the present invention in its collapsed, retracted position.
Figure 2:
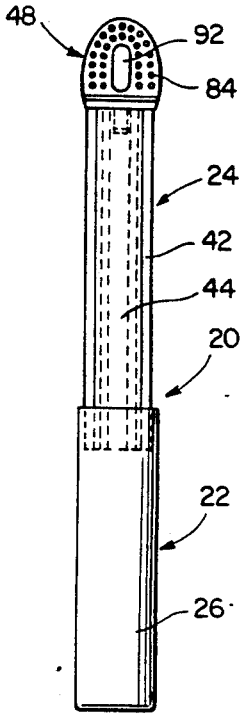
FIG. 2 is an elevational view similar to FIG. 1 but illustrating the toothbrush in extended position.
Figure 3:
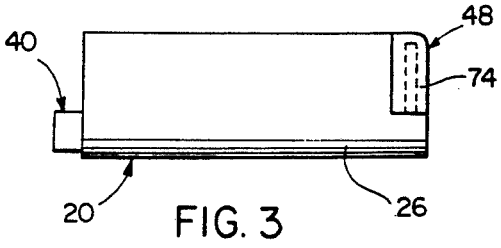
FIG. 3 is a horizontal, side elevational view of the toothbrush in the position illustrated in FIG. 1.
Figure 4:
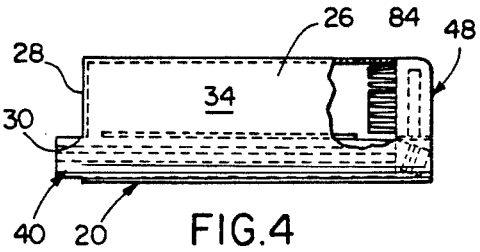
FIG. 4 is a side elevational view similar to FIG. 3 with a portion of the housing broken away illustrating the position of the bristle head.
Figure 10:
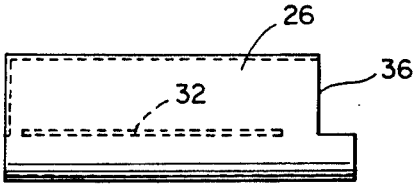
FIG. 10 is a side elevational view of the tubular housing.
Figure 9:
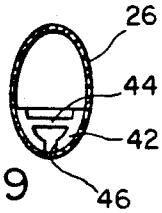
FIG. 9 is an end elevational view of the tubular housing.
Figure 5:
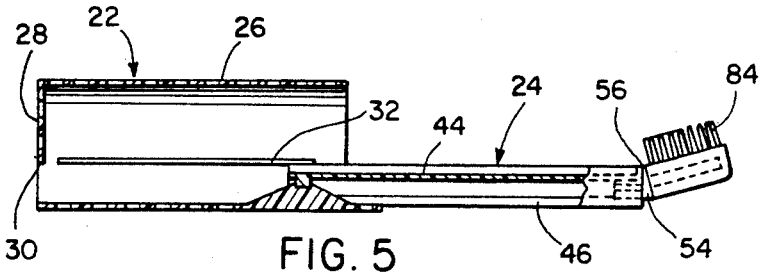
FIG. 5 is a horizontal elevational view, with portions in section, illustrating the toothbrush in extended position

Referring now specifically to the drawings, the disposable toothbrush of the present invention is generally designated by reference numeral 20 and includes two basic components including a tubular housing 22 and a brush head carrier and brush head generally designated by reference numeral 24 in which the brush head carrier is longitudinally slidable in the housing 22 from a collapsed or retracted position as illustrated in FIG. 1 to an extended position illustrated in FIGS. 2 and 5. The tubular housing 22 is in the form of a hollow plastic body 26 having an oval-shaped transverse cross-sectional configuration as illustrated in FIG. 9. One end of the tubular body 26 is provided with a partial closure wall 28 and an open bottom area 30 which enables sliding movement of the carrier and bristle head 24 therethrough to a limited degree as illustrated in FIGS. 3 and 4. A horizontal partition 32 is provided in engagement with the carrier and bristle head 24 and to provide a storage compartment 34 in the tubular body 26. The end of the tubular body 26 opposite from the wall 28 is open. The length of the housing 22 is approximately 3" and the major diameter of the oval-shaped transverse configuration is approximately 1" or slightly over 1" and generally conforms in shape and configuration to the shape of a well known commercially available cigarette lighter and conveniently fits in the pocket of a garment without it being noticeable. As illustrated, one end of the tubular body 26 is provided with a recess 36 which receive a portion of the bristle head carrier and bristle head when in the collapsed position as illustrated in FIG. 4.

Figure 11:
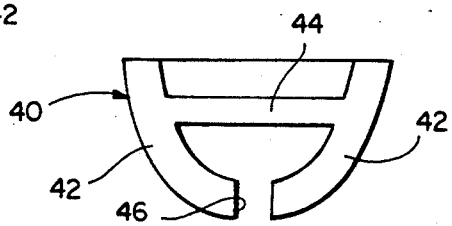
FIG. 11 is an end view of the brush head carrier.
Figure 12:
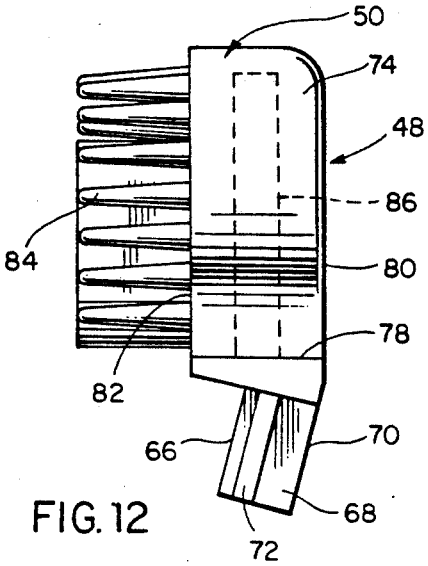
FIG. 12 is an enlarged elevational view of the brush head.
Figure 13:
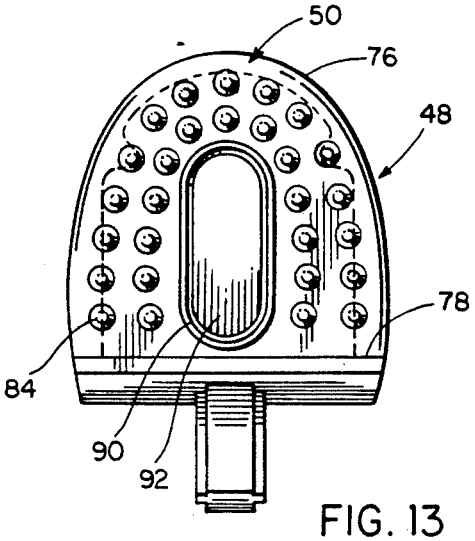
FIG. 13 is a side elevational view of the construction of FIG. 12.
Figure 14:
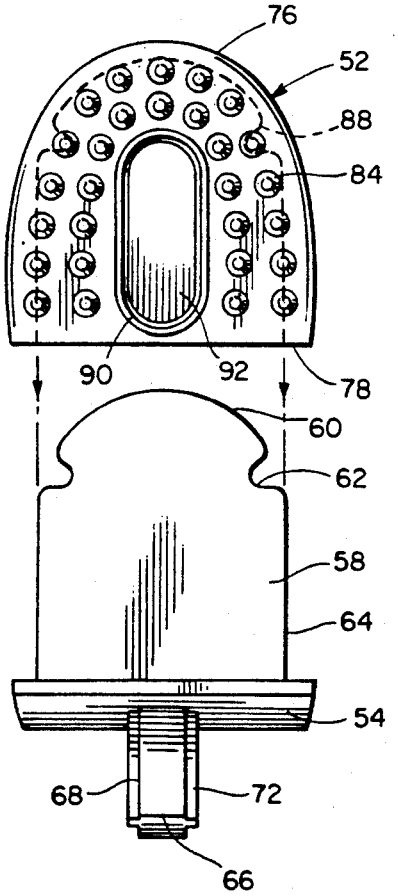
FIG. 14 is an exploded elevational view of the brush head illustrating the detachable connection between the brush head and its mounting arrangement.
Figure 15:
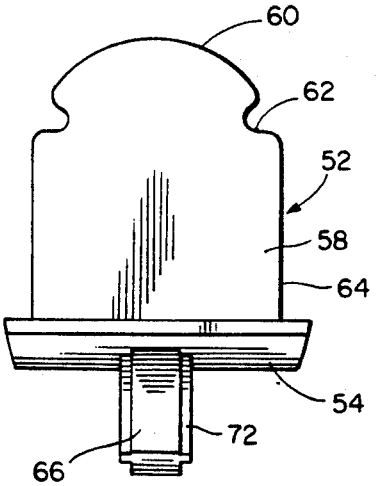
FIG. 15 is an elevational view of the mounting structure for the brush head for connecting it to the carrier.
Figure 16:
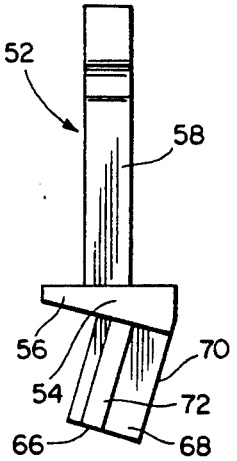
FIG. 16 is a side elevational view of the mounting structure for the brush head.
Figure 17:
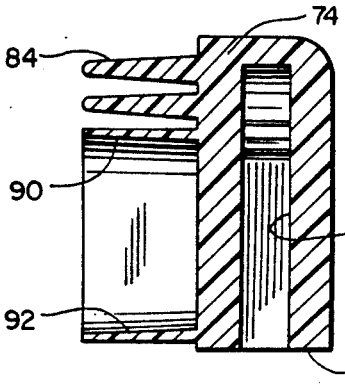
FIG. 17 is an enlarged sectional view of the brush head.

The bristle head carrier and bristle head includes an elongated carrier 40 which includes a pair of curved side members 42 interconnected by a transverse web 44 with the adjacent ends of the curved members being spaced to define a slot 46. As illustrated in FIG. 11, the configuration of the carrier 40 conforms with and slidably engages the interior of the lower portion of the tubular body 26 below the partition wall 32 as illustrated in FIG. 9. The overall length of the carrier 40 is such that one end thereof projects from the open end portion 30 of the tubular body 26 when in the retracted position as illustrated in FIG. 4.

Figure 6:
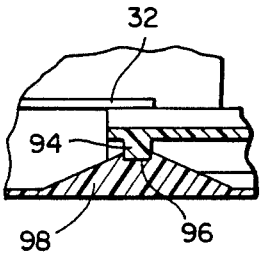
FIG. 6 is a sectional view of the carrier latch.
Figure 7:
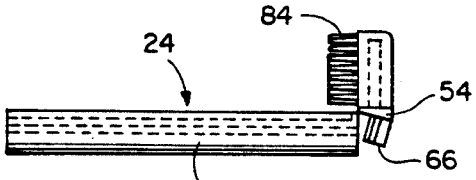
FIG. 7 is a side elevational view of the bristle head carrier and bristle head with the bristle head in perpendicular relation to the carrier.
Figure 8:
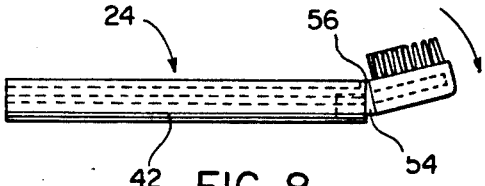
FIG. 8 is a side elevational view similar to FIG. 7 but illustrating the bristle head pivoted to its use position.

Attached to the outer end of the carrier 40 is a brush head 48 which includes a bristle assembly 50 and a mounting structure 52. The mounting structure 52 includes a wedge-shaped member 54 having the narrow edge thereof connected with the carrier at its upper edge by a living hinge 56 which enables the wedge-shaped number 54 to pivot from a position engaging the end edge of the carrier as illustrated in FIG. 7 to a position generally in alignment with the upper edge of the carrier as illustrated in FIG. 6 in which the bristle assembly is substantially perpendicular to the carrier. The upper surface of the wedge-shaped member includes a mounting plate 58 of generally rectangular configuration and provided with a reduced, curved upper edge 60 having a pair of opposed inwardly extending generally semi-cylindrical notches or recesses 62 formed therein at the juncture between the curved outer edge 60 and the parallel side edges 64 of the mounting plate 58. The mounting plate 58 is rigidly connected with and of unitary construction with the wedge member 54. Extending from the lower, inclined surface of the wedge number 54 is a retaining projection 66 that is unitary with the wedge member 54 and is relatively short and oriented in perpendicular relation to the inclined surface of the wedge member 54. The retaining projection 66 includes parallel side edges 68 and parallel edges 70 perpendicular to the edges of surfaces 68 to form a generally rectangular member with the surfaces 68 including a pair of longitudinally extending ribs 72. The retaining projection 66 is constructed to swing arcuately from a position spaced slightly from the end edge of the carrier 40 as illustrated in FIG. 6 to a position received internally of the slot or groove 46 with the rib 72 passing through the slot 46 in the carrier 40 which can be deformed sufficiently to enable the ribs to pass therethrough with the ribs then retaining the wedge member 54 with its incline surface against the end of the carrier 40 as illustrated in FIGS. 5 and 7.

The bristle assembly 50 includes a generally semi-oval body 74 including an arcuate outer edge 76 and a straight, rectangular inner edge 78 and parallel surfaces 80 and 82 with the surface 82 including a plurality of tapering plastic bristles 84 formed unitarily thereon. A hollow cavity 86 extends inwardly from the flat surface 78 with the hollow cavity 86 telescopically receiving the mounting plate 58 with the inner end of the cavity 86 conforming with the curvature of the outer edge 60 of the mounting plate 50 and provided with inwardly extending projections 88 which snap into the recesses or notches 62 to detachably lock the body 74 to the mounting plate 58. The surface 82 is also provided with a generally oval-shaped projection 90 which forms a cup-like cavity 92 to receive a quantity of dentifrice 94 therein.

This structure enables replacement of the bristle assembly 52 to enable multiple uses of the disposable toothbrush. A plurality of bristle assemblies 52 may be stored in the cavity 34 in the housing 22 with each bristle assembly being preloaded with a quantity of dentifrice. A single use form of the invention may also be provided in which the bristle assembly 52 is unitary with the mounting plate 58 so that the toothbrush is disposed of after a single use.

The disposable toothbrush is normally carried in its collapsed position and when it is to be used, the projecting end of the carrier 40 is engaged and moved toward the housing to disengage the bristle head 48 from the other end of the housing. The bristle head 48 then may be pulled outwardly until the projection 94 on the carrier engages a recess 96 formed in an upwardly thickened portion 98 formed in the lower surface of the housing adjacent the end thereof having the recess 36 therein which secures the bristle head in extended position. The bristle head 48 is pivoted to its angulated position with the retaining projection 66 retaining the bristle head in this position. The bristle head is then held under running water and utilized in the conventional manner of a toothbrush and the entire toothbrush can be disposed of after one use or if it is a multiple use model, the bristle assembly 50 can be removed and a new bristle head 50 placed in position and the carrier and bristle head 24 returned to its retracted position.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A disposable toothbrush comprising a pair of telescopically arranged components with one of the components being in the form of a tubular housing, the other of said components including an elongated brush head carrier slidably received in the tubular housing, a brush head mounted on one end of the brush head carrier for movement from a position adjacent one end of the tubular housing to an extended position remote therefrom, said brush head forming a closure for one end of the tubular housing when the toothbrush is in retracted position, said tubular housing forming a handle for the toothbrush when the brush head carrier and brush head are in their extended position, said tubular housing having a partial closure wall at the opposite end and being of a size to be easily grasped when using the device as a toothbrush and positionable in a pocket without producing a noticeable distortion when the brush head and carrier are telescoped into the housing, said brush head being pivotally mounted on the carrier for pivotal movement between a position perpendicular to the carrier to engage with and close the end of the tubular housing when in retracted position and an angulated position for use as a toothbrush when in extended position.

2. The disposable toothbrush as defined in claim 1 wherein said brush fiead includes a plurality of tapered plastic bristles on one surface thereof, a cup-shaped cavity defined in the brush head with the cavity being peripherally surrounded by said bristles, said cavity adapted to receive a quantity of dentifrice preloaded therein thereby requiring the application of water only to enable the toothbrush to be used.

3. The disposable toothbrush as defined in claim 2 wherein said cavity is defined by a projecting peripheral wall on the brush head with the outer edge of the peripheral wall terminating generally in the same plane as the tips of the tapered bristles.

4. The disposable toothbrush as defined in claim 3 wherein said brush head includes a mounting structure including a wedge-shaped member connected to the end of the carrier to orient the brush head in angular relation to the carrier when the brush head and carrier are moved to extended position to position the bristles on the brush head in optimum relation to the longitudinal axis of the toothbrush for effective tooth brushing.

5. The disposable toothbrush as defined in claim 4 wherein said mounting structure includes a mounting plate extending from the wedge-shaped member, said brush head including a bristle assembly having a body provided with a cavity slidable over and telescopically arranged with respect to the mounting plate and means releasably connecting the body to the mounting plate to enable the bristle assembly to be assembled onto.

6. The disposable toothbrush as defined in claim 5 wherein said means releasably connecting the bristle assembly body to the mounting plate including a pair of notches on the opposite side edge portions of the mounting plate and projections in a cavity in the body for snap engagement with the notches thereby releasably connecting the body to the mounting plate.

7. The disposable toothbrush as defined in claim 6 together with co-acting means on the carrier and the tubular housing to releasably latch the carrier and brush head in extended position.

8. The disposable toothbrush as defined in claim 7 wherein said tubular housing is generally oval-shaped in configuration with the brush head including an oval-shaped configuration generally corresponding to the shape of the tubular housing to form a closure for the tubular housing when in collapsed condition, said tubular housing including a longitudinal partition wall therein, said carrier being slidable between the partition wall and a peripheral wall of the housing, said carrier including an elongated member having a pair of inwardly curved side members having terminal edges spaced from each other to define a longitudinal slot, said wedge-shaped member having a retaining latch projecting therefrom with lateral ribs for movement through the slot to retain the bristle head in angular relation to the carrier when in extended position

9. The disposable toothbrush as defined in claim 8 wherein said tubular housing has a recess in one end thereof to receive the bristle head when the bristle head is in retracted position with the tapered bristles entering the open end of the tubular housing with the body of the bristle head forming a closure for the tubular housing.

10. The disposable toothbrush as defined in claim 9 wherein the overall length of the disposable toothbrush is approximately 6" when in extended position and approximately 3" when in retracted position with the major diameter of the oval-shaped housing being approximately 1" to enable easy handling and transport of the disposable toothbrush.

11. The disposable toothbrush as defined in claim 10 wherein said tubular housing, carrier, brush head and bristles are all constructed of plastic material thereby making it economically feasible to dispose of the toothbrush after a single use or a limited number of uses.

12. The disposable toothbrush as defined in claim 1 wherein said brush head includes a body having a bristle assembly thereon and a mounting plate connected with one end of said brush head carrier, said body having a cavity therein receiving said mounting plate, and means retaining the body and mounting plate in assembled relation.

13. The disposable toothbrush as defined in claim 17 wherein said bristle assembly includes a plurality of bristles on one surface of the body and a dentifrice cavity in said one surface, said bristles being disposed outwardly of and around a major potion of the cavity thereby enabling the cavity to be preloaded with dentifrice and assembled on the mounting plate.

* * * * *